US009741501B2

(12) United States Patent
Zou

(10) Patent No.: US 9,741,501 B2
(45) Date of Patent: Aug. 22, 2017

(54) THIN-FILM SWITCH

(71) Applicant: JIANGSU TRANSIMAGE TECHNOLOGY CO., LTD, Yangzhou, Jiangsu Province (CN)

(72) Inventor: Weimin Zou, Yangzhou (CN)

(73) Assignee: Jiangsu Transimage Technology Co., Ltd., Yangzhou (CN)

( * ) Notice: Subject to any disclaimer, the term of this patent is extended or adjusted under 35 U.S.C. 154(b) by 0 days.

(21) Appl. No.: 15/002,606

(22) Filed: Jan. 21, 2016

(65) Prior Publication Data

US 2017/0186565 A1 Jun. 29, 2017

(30) Foreign Application Priority Data

Dec. 24, 2015 (CN) ..... 2015 1 09821821
Dec. 24, 2015 (CN) ..... 2015 2 10889695 U
Dec. 30, 2015 (CN) ..... 2015 1 10192445

(51) Int. Cl.
*H01H 1/10* (2006.01)
*H01H 3/12* (2006.01)

(52) U.S. Cl.
CPC ..... *H01H 3/12* (2013.01); *H01H 2227/004* (2013.01)

(58) Field of Classification Search
CPC ..... H01H 3/12; H01H 2227/004
USPC ..... 200/512
See application file for complete search history.

(56) References Cited

U.S. PATENT DOCUMENTS 4,249,044 A * 2/1981 Larson ..... H01H 13/702 200/306
5,810,604 A * 9/1998 Kopp, Jr. ..... G09B 5/062 200/5 A

* cited by examiner

*Primary Examiner* — Edwin A. Leon
*Assistant Examiner* — Lheiren Mae A Caroc
(74) *Attorney, Agent, or Firm* — Rankin, Hill & Clark LLP

(57) ABSTRACT

A thin-film switch includes an upper conducting layer, a lower conducting layer and an insulating layer, wherein the insulating layer is located between the upper conducting layer and the lower conducting layer, one of the upper conducting layer and the lower conducting layer includes a conducting circuit layer and an anode triggering portion and a cathode triggering portion that are arranged on the conducting circuit layer, the other layer includes a first base material and a conductor that is arranged on the first base material and is conducted with the anode triggering portion and the cathode triggering portion. Both the anode triggering portion and the cathode triggering portion are arranged on the upper conducting layer or the lower conducting layer at the same time, the corresponding lower conducting layer or upper conducting layer is provided with the conductor with a conducting function, the conductor contacts with both the anode triggering portion and the cathode triggering portion at the same time when pressing the thin-film switch, both the anode and the cathode are conducted, and the switch is on.

2 Claims, 1 Drawing Sheet

THIN-FILM SWITCH

TECHNICAL FIELD

The invention relates to an electronic switch, and in particular to a thin-film switch.

BACKGROUND

The existing thin-film switch adopts a three-layer type structure, which includes an upper conducting layer, an insulating layer and a lower conducting layer. Both the upper conducting layer and the lower conducting layer are provided with a triggering portion, the triggering portion is connected with an anode and a cathode respectively, the triggering portion on the upper conducting layer contacts with the triggering portion on the lower conducting layer when pressing the thin-film switch, so that both the anode and the cathode are conducted and the switch is on. Both the upper conducting layer and the lower conducting layer need to be provided with a circuit at the same time to turn on the switch, so that the production process of the thin-film switch is complicated and the cost is higher.

Moreover, the existing circuit is generally formed through a printed silver wire, and a jumper wire is arranged in a mode of erecting a connecting wire above the circuit board. In order to avoid the short circuit, an insulating layer needs to be arranged between the circuit board and the jumper wire. If the insulating layer is not arranged in place, short circuit or poor contact is easy to take place to the circuit board.

SUMMARY

Invention object: the object of the invention is to provide a thin-film switch with simple structure, excellent performance and cost saving.

Technical scheme: a thin-film switch according to the invention includes an upper conducting layer, a lower conducting layer and an insulating layer, wherein the insulating layer is located between the upper conducting layer and the lower conducting layer, one of the upper conducting layer and the lower conducting layer includes a conducting circuit layer and an anode triggering portion and a cathode triggering portion that are arranged on the conducting circuit layer, the other layer includes a first base material and a conductor that is arranged on the first base material and is conducted with the anode triggering portion and the cathode triggering portion. The upper conducting layer is deformed when pressing the thin-film switch, so that the conductor contacts with both the anode triggering portion and the cathode triggering portion at the same time, both the anode and the cathode are conducted, and the switch is on.

To be specific, the conducting circuit layer includes a main circuit layer, an auxiliary circuit layer and a second base material that is located between the main circuit layer and the auxiliary circuit layer, the auxiliary circuit layer is provided with at least one conducting circuit, the second base material is provided with at least a pair of through holes, any conducting circuit passes through the pair of through holes to form a conducting loop with the main circuit layer; and the anode triggering portion and the cathode triggering portion are located on the main circuit layer. The conducting circuit passes through the through hole to conduct with the main circuit layer, which replaces the existing insulating layer and a jumper wire and reduces the risk of circuit badness.

Preferably, the upper conducting layer or the lower conducting layer further includes a protective layer, and the conducting circuit is located between the protective layer and the second base material.

Beneficial effect: compared to the prior art, the invention has the advantages that: (1) according to the invention, both the anode triggering portion and the cathode triggering portion are arranged on the upper conducting layer or the lower conducting layer at the same time, the corresponding lower conducting layer or upper conducting layer is provided with the conductor with a conducting function, the conductor contacts with both the anode triggering portion and the cathode triggering portion when pressing the thin-film switch, both the anode and the cathode are conducted, and the switch is on; compared to that the anode triggering portion and the cathode triggering portion are separately arranged in the upper conductor and the lower conductor traditionally, the thin-film switch according to the invention only needs to arrange the conducting circuit on the layer that is arranged with the anode triggering portion and the cathode triggering portion, so the technique is simple, the production efficiency is high, and the production cost can be greatly reduced by arranging the single layer as well; and (2) according to the invention, the base material of the conducting circuit board is drilled with holes, the conducting circuit passes through the through holes to conduct with the main circuit layer, which can replace the existing insulating layer and the jumper wire, so that the risk of the poor circuit is effectively reduced and the yield is improved.

DETAILED DESCRIPTION OF THE PREFERRED EMBODIMENTS

The technical scheme of the invention is further described hereinafter with reference to the drawings.

Figure 1:
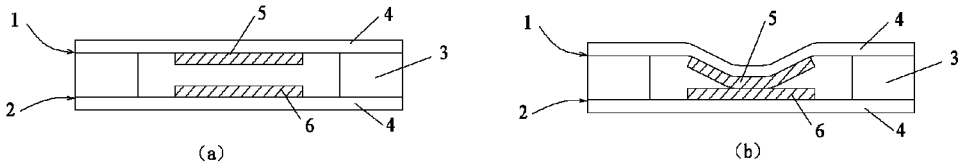
Fig. 1 (Prior Art)
FIG. 1 is a schematic structural diagram of a thin-film switch in the prior art, wherein (a) the state when disconnecting, and (b) the state when connecting.

As shown in FIG. 1, wherein the traditional thin-film switch includes an upper conducting layer 1, a lower conducting layer 2 and an insulating layer 3 located between the upper conducting layer 1 and the lower conducting layer 2, the structure of the upper conducting layer 1 is the same as the structure of the lower conducting layer 2, both the upper conducting layer and the lower conducting layer are provided with a conducting circuit layer 4 and a triggering portion located on the conducting circuit layer 4, wherein the triggering portion of the upper conducting layer 1 is connected with an anode as an anode triggering portion 5, and the triggering portion of the lower conducting layer 2 is connected with the cathode as a cathode triggering portion 6. When disconnecting, the anode triggering portion 5 is separated from the cathode triggering portion 6; while the thin-film switch is pressed, the upper conducting layer 1 is deformed due to being pressed, and the anode triggering portion 5 contacts with the cathode triggering portion 6, so that the anode and the cathode are conducted and the switch is on.

Figure 2:
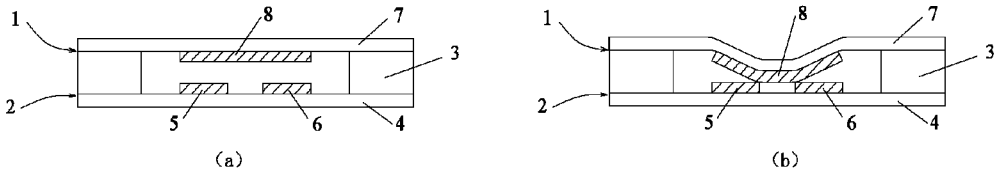
FIG. 2 is a schematic structural diagram of a thin-film switch in the invention, wherein (a) the state when disconnecting, and (b) the state when connecting.

As shown in FIG. 2, the thin-film switch according to the invention includes an upper conducting layer 1, a lower conducting layer 2 and an insulating layer 3 located between the upper conducting layer 1 and the lower conducting layer 2. The lower conducting layer 2 includes a conducting circuit layer 4, the conducting circuit layer 4 is provided with an anode triggering portion 5 and a cathode triggering portion 6, the upper conducting layer 1 includes a first base material 7, and the first base material 7 is provided with a conductor 8 that is conducted with the anode triggering portion 5 and the cathode triggering portion 6. When disconnecting, the anode triggering portion 5 and the cathode triggering portion 6 are separated from the conductor 8; while the thin-film switch is pressed, the upper conducting layer 1 is deformed due to being pressed, and the conductor 8 contacts with both the anode triggering portion 5 and the cathode triggering portion 6 at the same time, so that the anode and the cathode are conducted and the switch is on.

The conductor 8 can be any triggering point with a conducting function, such as a conducting metal triggering point as silver point, copper point and the like or a non-metal triggering point as carbon point and the like. The conducting circuit layer 4 and the corresponding anode triggering portion 5 and cathode triggering portion 6 can also be arranged in the upper conducing layer 1, and the corresponding conductor 8 can be arranged in the lower conducting layer 2.

Compared to that the anode triggering portion 5 and the cathode triggering portion 6 are separately arranged in the conducting circuit layer 4 of the upper conducting layer 1 and the lower conducting layer 2 traditionally, the thin-film switch according to the invention only needs to arrange the conducting circuit layer 4 on the layer that is arranged with the anode triggering portion 5 and the cathode triggering portion 6, so the technique is simple, the production efficiency is high, and the production cost can be greatly reduced by arranging the circuit on the single layer as well; moreover, the traditional connecting mode of the anode triggering portion 5 and the cathode triggering portion 6 is point contact connection, but according to the invention, the anode triggering portion 5 and the cathode triggering portion 6 contact with the conductor 8 at the same time, and the formed connecting mode is face contact connection, which can effectively avoid bad phenomena like short circuit and the like due to long-term pressure of the circuit of the thin-film switch.

Figure 3:
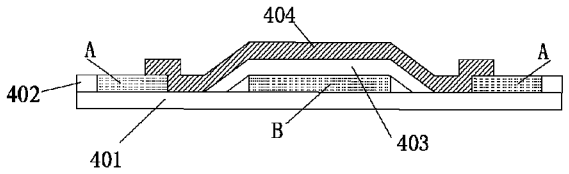
Fig. 3 (Prior Art)
FIG. 3 is a schematic structural diagram of a conducting circuit board in the prior art.

As shown in FIG. 3, the conducting circuit layer 4 in the traditional thin-film switch generally includes a base material 401 and a main circuit layer 402, the main circuit layer 402 includes a plurality of crossed circuits, such as circuit A and circuit B in the figure. In order to avoid short circuit when the circuits are crossed, an insulating medium 403 is arranged between the circuit B and the circuit A and a jumper wire 404 is erected above the insulating medium 403 to connect the circuit A. In this way, the production process is complicated and the cost is high; moreover, it is easy to lead to poor function of the whole conducting circuit as the insulating medium 403 is not machined in place.

Figure 4:
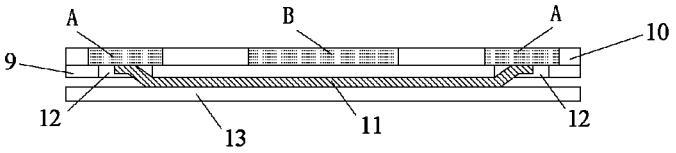
FIG. 4 is a schematic structural diagram of a conducting circuit board in the invention.

As shown in FIG. 4, according to the invention, the conducting circuit layer 4 includes a second base material 9, a main circuit layer 10 is arranged above the second base material 9, and the anode triggering portion 5 and the cathode triggering portion 6 are located on the main circuit layer 10. The second base material 9 is provided with at least a pair of through holes 12; an auxiliary circuit layer is arranged below the second base material 9, the auxiliary circuit layer includes at least one conducting circuit 11, the conducting circuit 11 passes through the pair of through holes 12 to form a conducting loop with the main circuit layer 10, and the conducting loop can replace the existing insulating layer and the jumper wire. In the figure, the main circuit layer 10 includes a circuit A and a circuit B which are arranged in a crossing mode, and the circuit A is connected through the conducting circuit 11. Compared to the traditional conducting circuit layer, the risk of the poor circuit can be effectively reduced and the yield is improved; at the same time, the technique is simple and the production cost is reduced.

When the conducting circuit layer 4, the anode triggering portion 5 and the cathode triggering portion 6 are located in the upper conducting layer 1, the main circuit layer 10 is arranged below the second base material 9, the auxiliary circuit layer including the conducting circuit 11 is arranged above the second base material 9, and the conducting circuit 11 passes through the pair of through holes 12 to form the conducting loop with the main circuit layer 10.

The upper conductor 1 or the lower conductor 2 can further includes a protective layer 13, and the conducting circuit 11 is located between the protective layer 13 and the second base material 9. As shown in FIG. 4, the upper portion of the conducting circuit 11 is the second base material 9, while the lower portion is the protective layer 13, and the protective layer 13 can be a protective film or other insulating material.

The invention claimed is:

1. A thin-film switch, comprising an upper conducting layer, a lower conducting layer and an insulating layer, wherein the insulating layer is located between the upper conducting layer and the lower conducting layer, one of the upper conducting layer and the lower conducting layer comprises a conducting circuit layer and an anode triggering portion and a cathode triggering portion that are arranged on the conducting circuit layer, the other layer comprises a first base material and a conductor that is arranged on the first base material and is conducted with the anode triggering portion and the cathode triggering portion, wherein the conducting circuit layer comprises a main circuit layer, an auxiliary circuit layer and a second base material that is located between the main circuit layer and the auxiliary circuit layer, the auxiliary circuit layer is provided with at least one conducting circuit, the second base material is provided with at least a pair of through holes, any conducting circuit passes through the pair of through holes to form a conducting loop with the main circuit layer; and the anode triggering portion and the cathode triggering portion are located on the main circuit layer.

2. The thin-film switch according to claim 1, wherein the upper conducting layer or the lower conducting layer further comprises a protective layer and the conducting circuit is located between the protective layer and the second base material.

* * * * *